US007013827B2

(12) United States Patent
Harland-White

(10) Patent No.: US 7,013,827 B2
(45) Date of Patent: Mar. 21, 2006

(54) MULTIPURPOSE UNDERWATER VEHICLE FOR CARRYING DIVERSE PAYLOADS AND METHOD OF USING SAME

(75) Inventor: Todd B. Harland-White, Annapolis, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/994,409

(22) Filed: Nov. 23, 2004

(65) Prior Publication Data

US 2006/0005759 A1 Jan. 12, 2006

Related U.S. Application Data

(60) Provisional application No. 60/529,739, filed on Dec. 17, 2003.

(51) Int. Cl.
*B63G 8/00* (2006.01)

(52) U.S. Cl. ..... 114/321

(58) Field of Classification Search ..... 114/312, 114/321, 238

See application file for complete search history.

(56) References Cited

U.S. PATENT DOCUMENTS

| | | | | |
|---|---|---|---|---|
| 4,108,101 | A * | 8/1978 | Schirtzinger | 114/245 |
| 4,805,549 | A | 2/1989 | Svenning et al. | |
| 5,335,881 | A * | 8/1994 | Zaguli | 244/171.9 |
| 5,487,350 | A | 1/1996 | Chace, Jr. et al. | |
| 5,493,993 | A | 2/1996 | Carter et al. | |
| 5,551,364 | A | 9/1996 | Cipolla et al. | |
| 5,675,116 | A * | 10/1997 | Hillenbrand | 114/21.2 |
| 5,675,117 | A * | 10/1997 | Hillenbrand | 114/21.2 |
| 5,786,545 | A * | 7/1998 | Hillenbrand | 114/21.2 |
| 6,276,294 | B1 * | 8/2001 | Geriene et al. | 114/312 |
| 6,640,740 | B1 | 11/2003 | French et al. | |
| 6,698,373 | B1 * | 3/2004 | Geriene et al. | 114/244 |

FOREIGN PATENT DOCUMENTS

| | | |
|---|---|---|
| WO | WO 03/011683 | 2/2003 |
| WO | WO 03/059734 | 7/2003 |

* cited by examiner

*Primary Examiner*—Stephen Avila
(74) *Attorney, Agent, or Firm*—Birch, Stewart, Kolasch & Birch, LLP

(57) ABSTRACT

An underwater vehicle includes an elongate body defining a longitudinal channel and having a waterproof interior with a processor operably connected to a memory in the interior, a payload holder in the channel for releasably securing a payload, and a communication port in the channel operably connected to the processor and connectable to a payload releasably secured to the payload holder.

36 Claims, 8 Drawing Sheets

MULTIPURPOSE UNDERWATER VEHICLE FOR CARRYING DIVERSE PAYLOADS AND METHOD OF USING SAME

CROSS-REFERENCE TO RELATED APPLICATIONS

The present application claims the benefit of U.S. Provisional Application No. 60/529,739 filed Dec. 17, 2003, the entire contents of which are hereby incorporated by reference.

FIELD OF THE INVENTION

The present invention is directed toward a multipurpose underwater vehicle for carrying diverse payloads and a method of using same, and, more specifically, toward a multipurpose underwater vehicle having an elongate body, a processor in the body interior, and a payload holder for releasably securing a payload, and to a method of using same.

BACKGROUND OF THE INVENTION

Ships and submarines may be equipped with torpedo tubes and associated systems for launching torpedoes. Non-weapon devices, which may include sonars or various sensors, for example, may also be launched though torpedo tubes. Generally, these sensor devices are torpedo-shaped so that they will fit through a torpedo tube and so that they can be stored on the same supports as torpedoes.

The use of single-purpose torpedo-shaped devices carrying sensors is known, and a plurality of such devices may be carried on a ship or boat, each for a particular purpose. Depending on the need at hand, a particular one of the torpedo-shaped devices is selected and discharged from a torpedo tube. Each of these devices, however, is substantially the same size as a torpedo and thus each device reduces the number of torpedoes that can be carried by one. This is a particular problem on submarines where storage space is limited.

To reduce the cost of developing future underwater vehicles for carrying out various missions, the use of modular vehicles has been considered. As illustrated in FIGS. 12 and 13, these vehicles may include three primary sections: a nose section 200, a tail section 210 and a payload section 220 or 234 mounted between the nose and tail sections. Each payload section 220, 234 is a self-contained module with all the sensors and processing circuitry 230, 230' necessary to perform a single mission. To use a given payload, a nose section and tail section are attached to a payload section and the assembled system is tested to ensure that it is watertight. To change payloads, the nose and tail sections must be removed and attached to a new payload, again with the need for testing to ensure proper assembly and that the system is watertight.

The use of such modular payloads reduces the room taken up by payloads to some extent, but the payloads are still large enough to require multiple persons and/or lifting equipment to manipulate. Thus, where prior, non-modular, sensing devices were each approximately as large as a torpedo, the above modular sensing devices take up half to three quarters as much space as a torpedo. It is desirable to provide an underwater vehicle for carrying payloads, suitable for discharge via torpedo tube or in a similar manner, which is usable with compact, modular payloads.

SUMMARY OF THE INVENTION

These problems and others are addressed by the present invention which comprises, in a first aspect, an underwater vehicle that includes an elongate body defining a longitudinal channel and having a waterproof interior with a processor and a memory in the interior. A payload holder is provided in the channel for releasably securing a payload. A communication port in the channel allows a payload connected to the payload holder to communicate with the processor.

Another aspect of the invention comprises an underwater vehicle having an elongate body defining a longitudinal channel with a waterproof interior and a processor in the interior operably connected to a memory. A payload holder is mounted in the channel as is a communication port. A payload is detachably connected to the payload holder and to the communications port.

A further aspect of the invention comprises a multipurpose sensing system that includes a torpedo-tube-launchable vehicle comprising an elongate body defining a longitudinal channel having a waterproof interior and a processor in the interior operably connected to a memory. A payload holder is mounted in the channel, and a communication port operably connected to the processor is provided. The system includes at least first and second sensors which can be operably connected, one at a time, to the communications port for communication with the processor. First and second programs specific to the first and second sensors are provided, and the program specific to the sensor connected to the communication port is stored in the memory.

An additional aspect of the invention comprises a method that includes the steps of providing a torpedo-tube-launchable vehicle comprising an elongate body defining a longitudinal channel having a waterproof interior and a processor in the interior operably connected to a memory. A payload holder for holding a payload in the channel is provided, and a communication port in the channel is operably connected to the processor. Then a first payload is selected from a plurality of different payloads that are connectable to the payload holder, and the selected payload is connected to the payload holder and to the communication port. A program specific to the first payload is loaded in the memory, and the vehicle is launched from a torpedo tube.

BRIEF DESCRIPTION OF THE DRAWINGS

These aspects of the invention and others will be better understood after a reading of the following detailed description of embodiments of the invention together with the following drawings, wherein.

DETAILED DESCRIPTION

Figure 1:
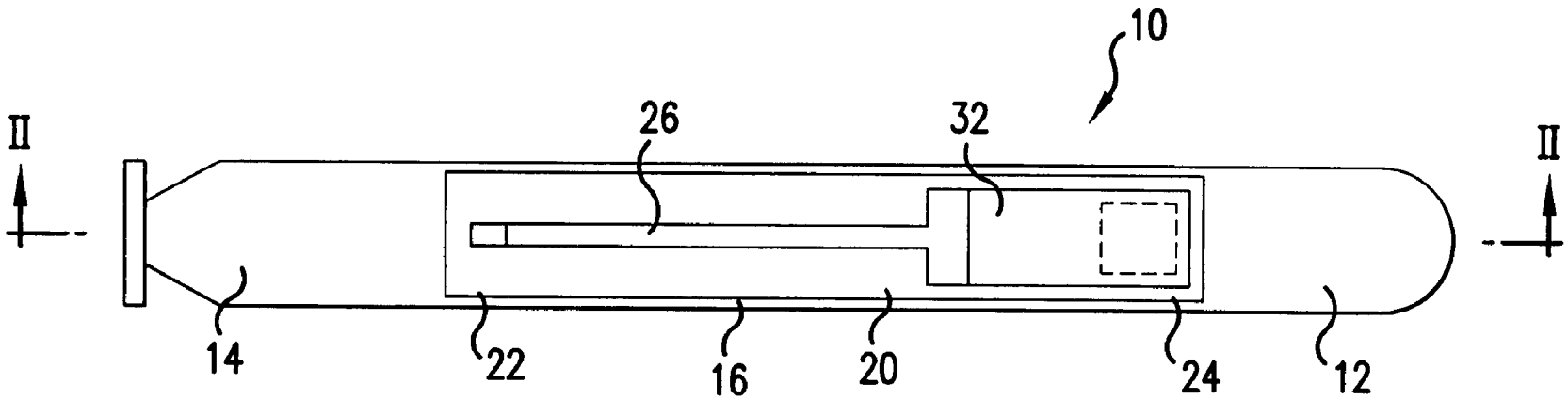
FIG. 1 is a top plan view of an underwater vehicle according to an embodiment of the present invention with a payload attached thereto.
Figure 2:
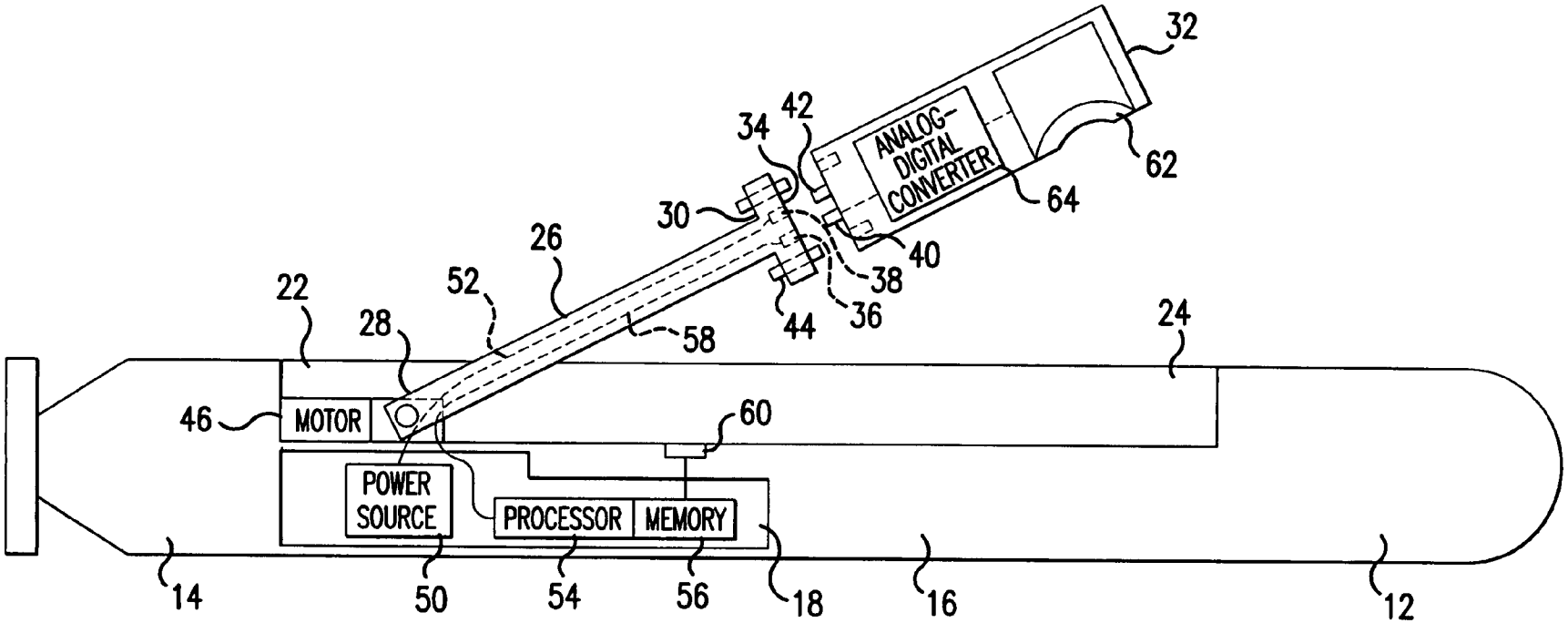
FIG. 2 is a sectional side elevational view taken through line II—II in FIG. 1.

Referring now to the drawings, wherein the showings are for purposes of illustrating embodiments of the invention only and not for purposes of limiting same, FIGS. 1 and 2 illustrate an underwater vehicle 10 comprising an integrally formed nose portion 12, tail portion 14 and central body portion 16 defining a watertight interior 18. A longitudinally extending channel 20 is formed in central body portion 16 having a first end 22 and a second end 24. While the channel is shown facing in an upward direction in many of the figures, it should be noted that the vehicle will operate equally well with the channel facing to one side of the vehicle or in a downward direction. The orientation of the channel will be determined by the nature of the sensor mounted therein and the direction it needs to face to perform its intended function.

An arm 26 is provided in channel 20 with a first end 28 and a second end 30 to which a payload, such as payload 32, may be attached. Second end 30 includes a mounting surface 34 that includes at least one communication port 36 and a power connector 38 for connection to a payload communication connector 40 and payload power connector 42, respectively on payload 32. Payload 32 is shown slightly spaced from mounting surface 34 for illustration purposes, but would, of course, be connected to the mounting surface 34 in use. Fasteners, such as bolts 44 on mounting surface 34 hold payload 32 securely to arm 26. Other connectors or other connecting arrangements for releasably securing a payload to the arm 26 could be used without exceeding the scope of this invention.

A motor 46 pivots arm 26 about its first end 28 between a first position, illustrated in FIG. 1, wherein the arm 26 is substantially completely contained within channel 20 and a second position, illustrated in FIG. 2, with second end 30 and any attached payload projecting out from channel 20. Some sensors must be spaced from underwater vehicle 10 to function properly; others may be used while in channel 20 and with such sensors, arm 26 need not be deployed. However, the pivotable nature of arm 26 facilitates the mounting and removal of payloads from arm 26 even when those payloads need not be deployed from the channel 20 during use.

Underwater vehicle 10 further includes a power source 50 connected to power connector 38 on arm 26 by a line 52, and a processor 54 operatively connected to a memory 56 and to communication port 36 by a line 58. A jack 60 is provided for loading programs into memory 56 as will be discussed hereafter.

Figure 3:
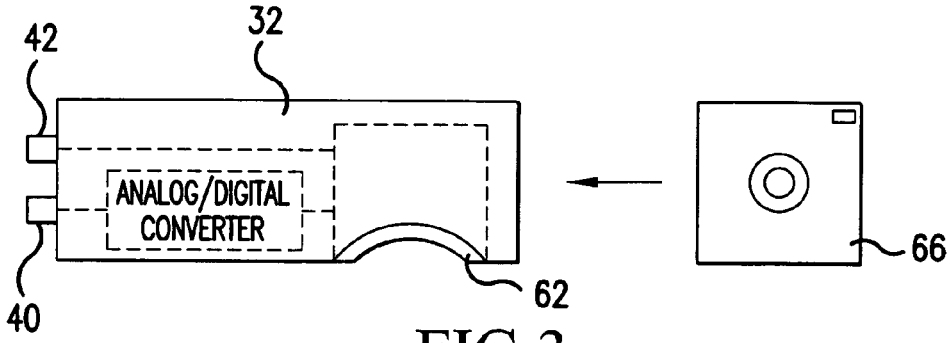
FIG. 3 schematically shows a first payload for use with the underwater vehicle of FIG. 1 and associated software for controlling the first payload.

First payload 32, shown in FIGS. 2 and 3, comprises a video camera 62 or other sensor designed for intelligence, surveillance and reconnaissance. As such, the video camera 62 must generally project above the surface of water surrounding underwater vehicle 10, and arm 26 must therefore be deployed when payload 32 is attached to arm 26. First payload 32 also includes an onboard analog/digital converter 64 for processing signals generated by video camera 62 and sending digital signals to processor 54 via payload communication connector 40 connected to communication port 36 and line 58. A first software program 66 contains instructions for controlling first payload 32 and receiving and storing data generated by first payload 32.

Figure 5:
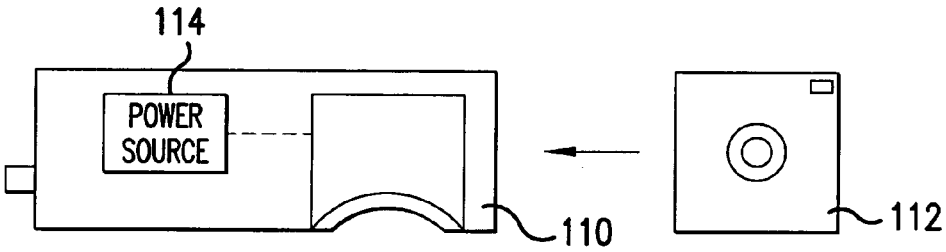
FIG. 5 schematically shows a third payload for use with the underwater vehicle of FIG. 1 and associated software for controlling the third payload.
Figure 6:
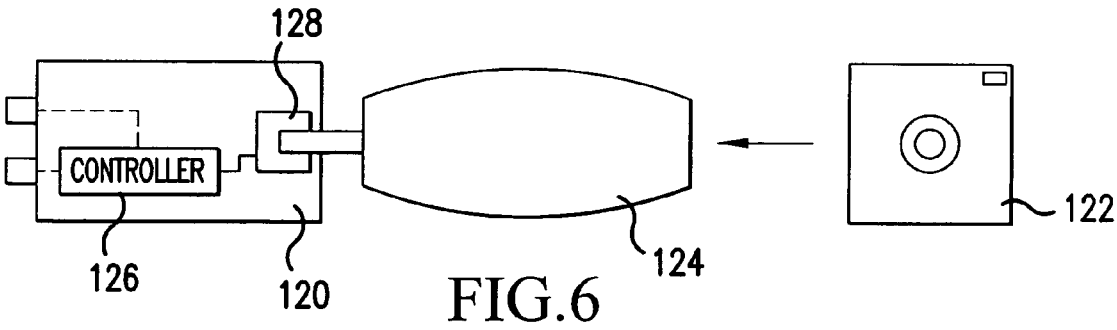
FIG. 6 schematically shows a fourth payload for use with the underwater vehicle of FIG. 1 and associated software for controlling the fourth payload.
Figure 7:
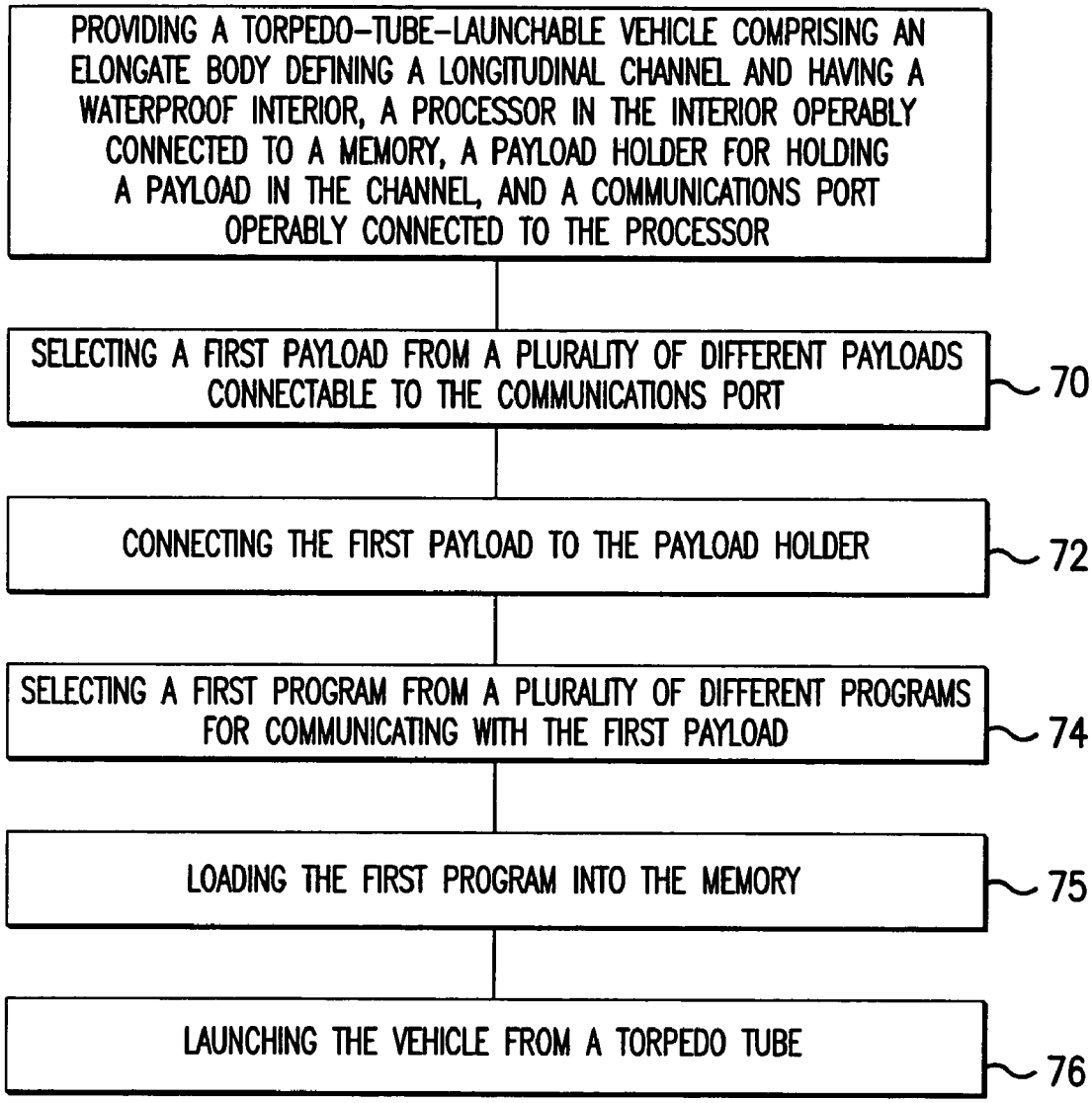
FIG. 7 is a flow chart illustrating a method of using the underwater vehicle of FIG. 1.

In use, with reference to FIG. 7, a first payload 32 is selected at a step 70 from a plurality of payloads 32, 100, 110, 120 illustrated in FIGS. 3–6, for example, and connected to payload holder 26 at step 72. Communications connector 40 on the selected payload is then connected to communication port 36 on the vehicle 10. A program, such as first software program 66 is selected at a step 74 from among several payload specific software programs 102, 112, 122, illustrated in FIGS. 3–6, and loaded into memory 56 via jack 60 at step 75. Underwater vehicle 10 is then placed into a torpedo tube (not shown) and launched from a ship or submarine (not shown) at step 76. The underwater vehicle operates remotely from the host ship that launches it, and may either transmit data to the host ship via a fiber optic or other cable or by radio. In some cases, the vehicle may operate autonomously with no connection to the host ship and record data onboard for later retrieval. The control and retrieval of the underwater vehicle are performed in a conventional manner and these processes do not form a part of the present disclosure. When a new payload, such as second payload 100 is used, first payload 32 is removed from the payload holder 26 and replaced with second payload 100, while second software program 102 is installed in memory 56, preferably replacing first program 66.

Beneficially, unlike in conventional underwater vehicles, payloads can be exchanged without violating the integrity of watertight interior 18. Thus, payloads can be attached and removed without the need for testing to ensure that watertight interior 18 remains watertight. Moreover, the use of software programs specific to the attached payload allows a general purpose processor to be used rather than dedicated processing circuitry 230, 230' that was found in conventional underwater vehicles. The software can also be loaded through a waterproof jack 60 without violating the integrity of the underwater vehicle 10. Moreover, maximizing the amount of equipment that is reusable with various payloads and minimizing the size of the modular payloads 32, 100, 110 and 120 increases the number of payloads that can be carried by a ship or submarine and thus increases the number of missions that can be performed while occupying a reduced amount of storage space.

Figure 4:
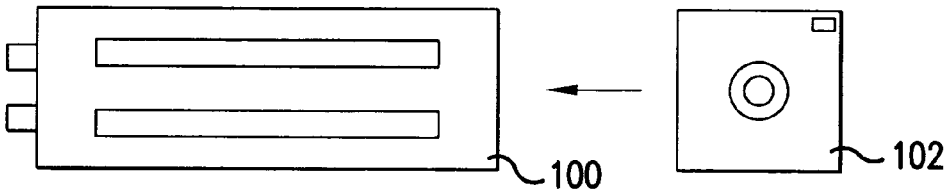
FIG. 4 schematically shows a second payload for use with the underwater vehicle of FIG. 1 and associated software for controlling the second payload.

FIG. 4 illustrates a second payload 100 and associated second operating software 102. Second payload 100 may be, for example, sidescan or minehunting sonar. When one of these sonars is used, vehicle 10 would be positioned with channel 20 facing generally downwardly, toward or at an angle to the sea floor. FIG. 6 illustrates a fourth payload 120 and associate fourth operating software 122. Fourth payload 120 may comprise a buoy 124 that is released from the underwater vehicle after it has been deployed. To this end, fourth payload 120 includes a controller 126 for controlling a clamp 128 or similar releasing mechanism which can be controlled to release buoy 124 at a given location after the underwater vehicle 10 has been launched and is a given distance away from the ship. When fourth payload 120 is used, vehicle 10 would generally be deployed with channel 20 facing upwardly, toward the surface of the water.

Figure 8:
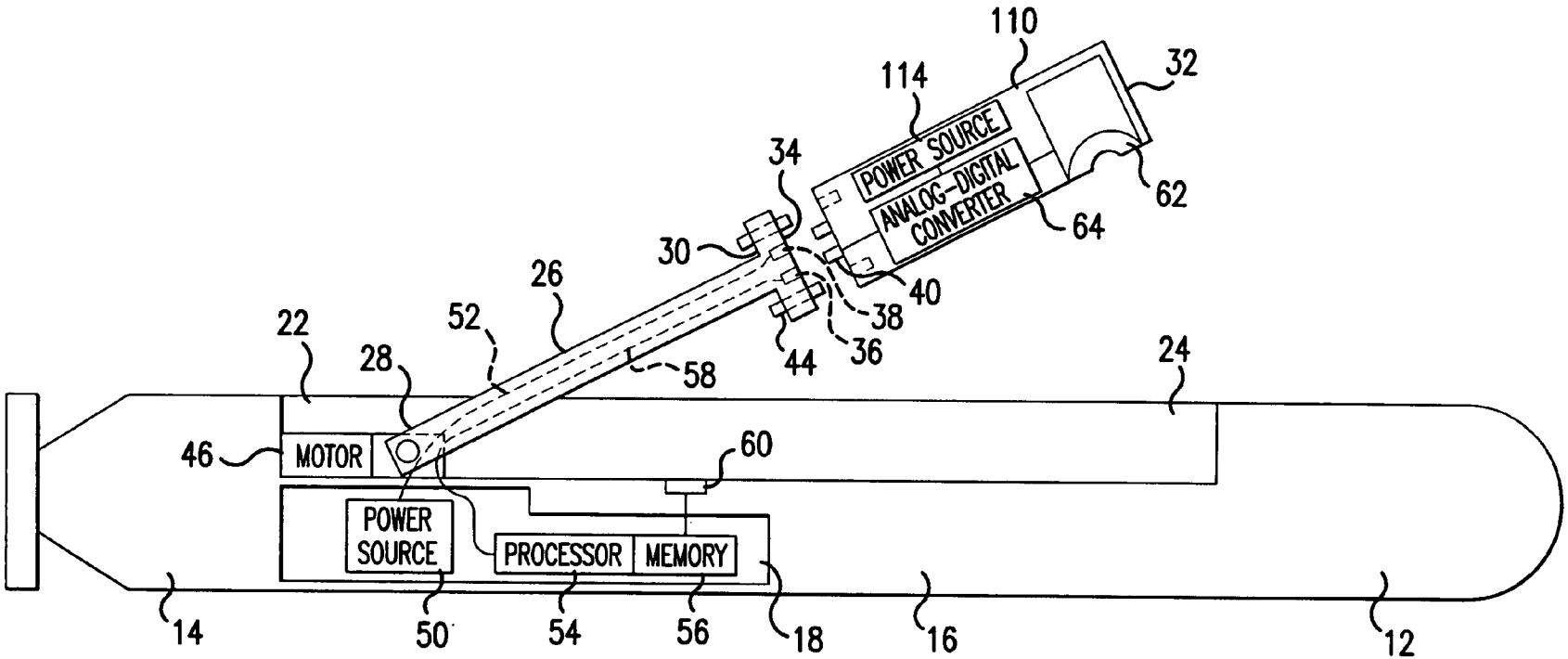
FIG. 8 is a sectional elevational view schematically illustrating a second type of payload connected to the underwater vehicle of FIG. 1.

FIG. 5 illustrates a third payload 110 and associated software 112, seen with the underwater vehicle 10 in FIG. 8. Third payload 110 differs from first payload 32 in that it includes its own internal power source 114 and thus does not require connection to power source 50 onboard the underwater vehicle. Such a payload can be used with an underwater vehicle that does not include its own power source or when payload 110 has specific power needs that cannot be met by power source 50.

Figure 9:
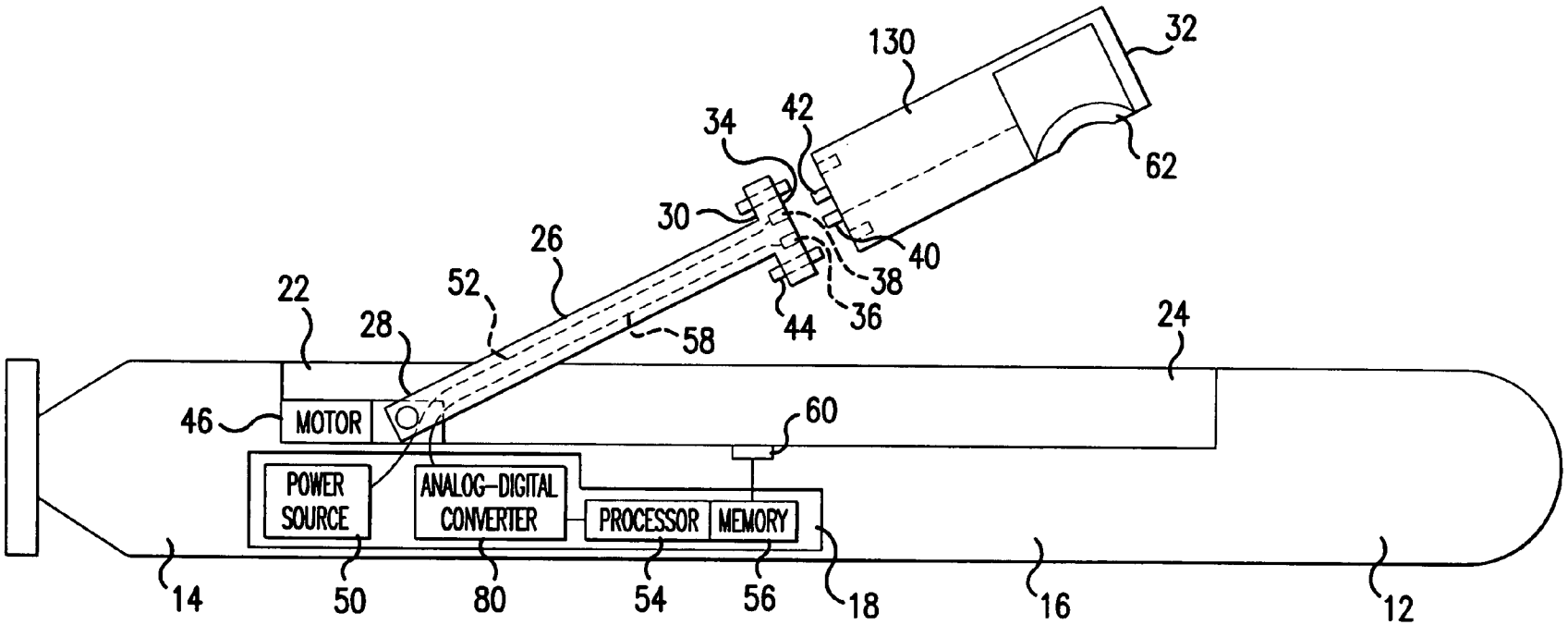
FIG. 9 is a sectional elevational view schematically illustrating a second embodiment of an underwater vehicle according to the present invention.

A second embodiment of the invention is illustrated in FIG. 9 wherein elements common to the first embodiment are identified with the same reference numerals. Fifth payload 130 illustrated in FIG. 9 does not include an internal analog/digital converter and therefore outputs an analog signal on line 58 that cannot be used directly by processor 54. Therefore, in this embodiment, underwater vehicle 10 includes an onboard analog/digital converter 80 in line 58 between fifth payload 130 and processor 54. While not specifically illustrated in FIG. 9, a switch could be provided for bypassing analog/digital converter 80 when a payload outputting a digital signal is used.

Figure 10:
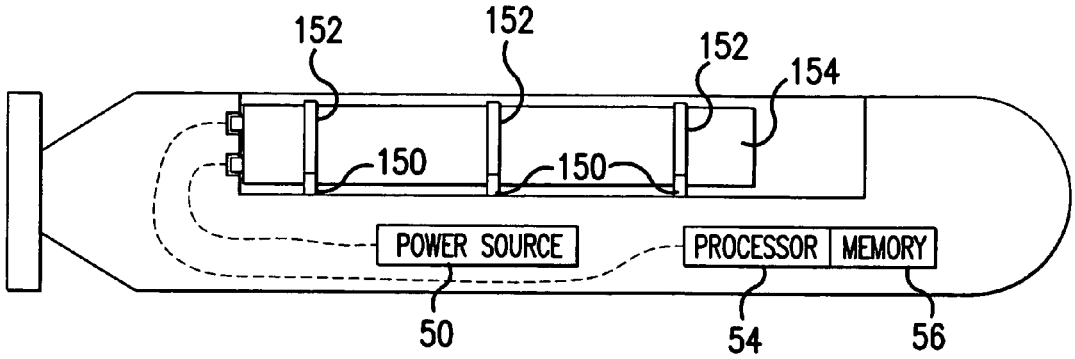
FIG. 10 is a sectional elevational view schematically illustrating a third embodiment of an underwater vehicle according to the present invention.
Figure 11:
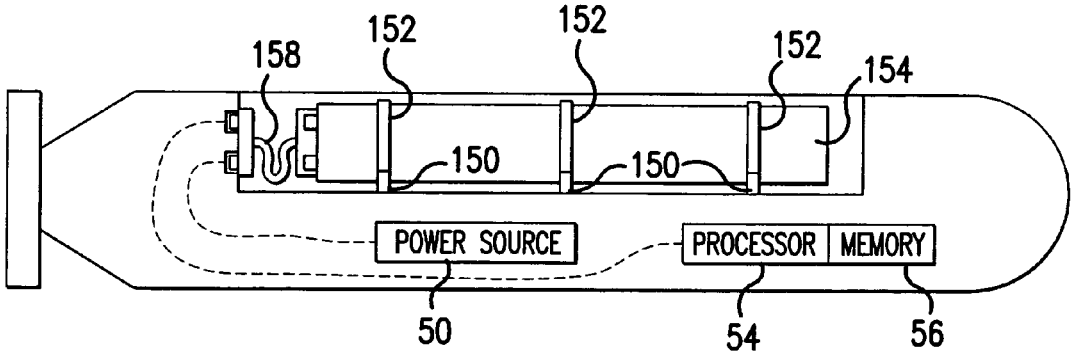
FIG. 11 is a sectional elevational view schematically illustrating an alternate arrangement for mounting a payload on the vehicle of FIG. 10.
Figure 12:
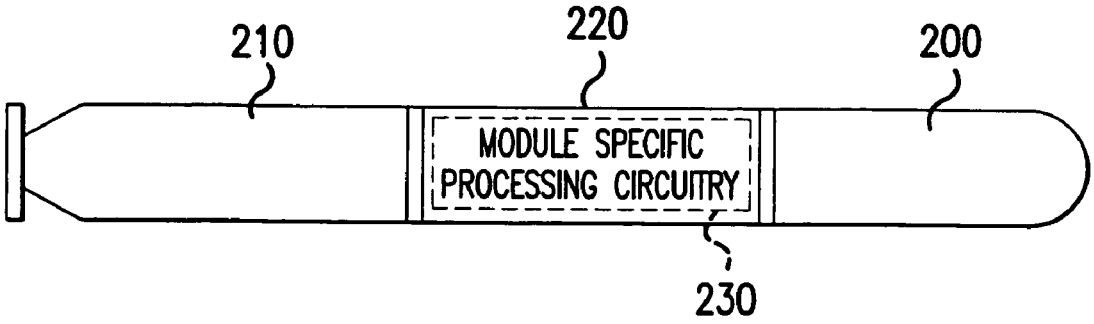
FIG. 12 is a conventional modular underwater vehicle including a first conventional modular payload.
Figure 13:
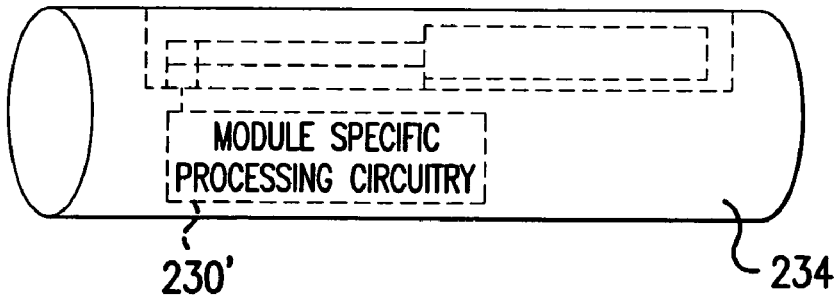
FIG. 13 is a conventional payload that can be used with the conventional modular underwater vehicle of FIG. 12.

Two versions of a third embodiment of the invention are illustrated in FIGS. 10 and 11. In this embodiment, a plurality of U-shaped payload holders 150 are provided in channel 20 in place of arm 26, and straps 152 or other elements are used to hold payload 154 in place. In this manner, larger payloads that do not require deployment outside of channel 20 can be used in vehicle 10. Communication port 36 and power connector 38 are provided in a wall of channel 20, for example, so that payload communications connector 40 and payload power connector 42 can be connected thereto by sliding payload 154 relative to the channel 20. Alternately, a separate connector 158, illustrated in the embodiment of FIG. 11, may be used to connect the payload 154 to the power source 50 and processor 54. Other arrangements for holding payload 154 in channel 20 can also be used without exceeding the scope of the invention.

The present invention has been described herein in terms of several embodiments. However, it should be understood that additions and changes to these embodiments may be made without exceeding the scope of this invention. It is intended that all such obvious modifications and additions form a part of this invention to the extent they fall within the scope of the several claims appended hereto.

I claim:

1. An underwater vehicle comprising:

an elongate body defining a longitudinal channel and having a waterproof interior;

a processor in said interior operably connected to a memory;

a payload holder in said channel for releasably securing a payload; and a communication port in said channel operably connected to said processor and connectable to a payload secured to the payload holder.

2. The vehicle of claim 1 wherein said memory is adapted to store a first set of instructions when a first payload is secured to said payload holder and a second set of instructions when a second payload is secured to said holder.

3. The vehicle of claim 1 further including a power connector in said channel for supplying power to a payload secured to said payload holder.

4. The vehicle of claim 1 where said channel is U-shaped.

5. The vehicle of claim 1 wherein said elongate body is cylindrical.

6. The vehicle of claim 1 wherein said payload holder comprises an arm disposed in said channel having a first end connected to said body and a second end.

7. The vehicle of claim 6 wherein said communication port and said power connector are located at said second end.

8. The vehicle of claim 6 wherein said arm is pivotably connected to said body and said second end is shiftable between a first position and a second position.

9. The vehicle of claim 7 wherein said second end is disposed in said channel when said arm is in said first position.

10. The vehicle of claim 8 wherein said second end is disposed outside said channel when said arm is in said second position.

11. The vehicle of claim 1 wherein said elongate body has a first end and a second end and further including a rounded nose section at the first end and a finned tail section at the second end.

12. The vehicle of claim 11 wherein said nose section and said tail section are integrally formed with said elongate body.

13. The vehicle of claim 11 wherein said nose section and said tail section are permanently connected to said elongate body.

14. The vehicle of claim 12 including an analog to digital converter operably connected between said communication port and said processor.

15. The vehicle of claim 14 including a power source operably connected to said power connector.

16. The vehicle of claim 1 wherein said elongate body is configured to be launchable from a torpedo tube.

17. An underwater vehicle comprising:

an elongate body defining a longitudinal channel and having a waterproof interior;

a processor in said interior operably connected to a memory;

a communication port in said channel operably connected to said processor; and a payload detachably mounted in said channel and releasably connected to said communication port.

18. The vehicle of claim 17 wherein said payload comprises a sensor.

19. The vehicle of claim 17 wherein said payload comprises an actuator.

20. The vehicle of claim 18 wherein said payload comprises an actuator.

21. The vehicle of claim 17 including a program specific to the payload stored in said memory.

22. The vehicle of claim 18 wherein said sensor includes an output connected to said communication port and an analog to digital converter operably connected to said output.

23. A multi-purpose sensing system comprising:

a torpedo-tube-launchable vehicle comprising an elongate body defining a longitudinal channel and having a waterproof interior;

a processor in said interior operably connected to a memory;

an arm having a first end and a second end mounted in said channel;

a communication port operably connected to said processor;

first and second sensors alternately operably connectable to said communication port for communication with said processor;

a first program for processing data from said first sensor; and a second program for processing data from said second sensor;

wherein said first program is stored in said memory when said first sensor is connected to said communication port and said second program is stored in said memory when said second sensor is connected to said communication port.

24. The multi-purpose sensing system of claim 23 wherein said arm is shiftable between a first position wherein said second end is disposed in said channel and a second position.

25. The multi-purpose sensing system of claim 24 wherein said arm second end is disposed externally of said channel when said arm is in said second position.

26. The multi-purpose sensing system of claim 25 wherein said arm is disposed perpendicularly to a longitudinal axis of said elongate body when said arm is in said second position.

27. The multi-purpose sensing system of claim 25 including a power source in said elongate body and a power connector in said channel for supplying power to the first sensor or the second sensor.

28. The multi-purpose vehicle of claim 25 wherein said first sensor includes a power source.

29. The multi-purpose vehicle of claim 25 wherein said first sensor includes a digital output connectable to said communication port and an analog to digital converter for producing a digital signal at said digital output.

30. The multi-purpose vehicle of claim 25 wherein said elongate body includes an analog output connectable to said communication port and said elongate body includes an analog to digital converter in communication with said communication port.

31. A method comprising the steps of:

providing a torpedo-tube-launchable vehicle comprising an elongate body defining a longitudinal channel and having a waterproof interior, a processor in the interior operably connected to a memory, a payload holder for holding a payload in the channel, and a communication port operably connected to the processor;

selecting a first payload from a plurality of different payloads connectable to the payload holder;

connecting the first payload to the payload holder;

connecting the first payload to the communication port;

selecting a first program from a plurality of different programs for communicating with the first payload;

loading the first program into the memory; and launching the vehicle from a torpedo tube.

32. The method of claim 31 including the additional step of deploying the payload holder from the channel after said step of launching the vehicle from a torpedo tube.

33. The method of claim 32 including the additional step of controlling the payload after said step of launching the vehicle from the torpedo tube.

34. The method of claim 32 including the additional step of storing data from the payload in the memory.

35. The method of claim 31 including the additional steps of:

retrieving the vehicle;

selecting a second payload from the plurality of payloads;

replacing the first payload with the second payload;

selecting a second program for communicating with the second payload;

replacing the first program in the memory with the second program; and launching the vehicle from a torpedo tube.

36. The method of claim 35 wherein said step of replacing the first payload with the second payload comprises the step of replacing the first payload with the second payload without opening the waterproof interior.

* * * * *